US011293390B2

(12) United States Patent
Revidat et al.

(10) Patent No.: US 11,293,390 B2
(45) Date of Patent: Apr. 5, 2022

(54) FUEL PUMP FOR A LIQUID FUEL INJECTION SYSTEM OF A MOTOR VEHICLE

(71) Applicants: Hyundai Motor Company, Seoul (KR); Kia Motors Corporation, Seoul (KR)

(72) Inventors: Stephan Revidat, Langen (DE); Johannes Ullrich, Trebur (DE)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/991,647

(22) Filed: Aug. 12, 2020

(65) Prior Publication Data

US 2021/0363951 A1 Nov. 25, 2021

(51) Int. Cl.

| | |
|---|---|
| ***F02M 51/04*** | (2006.01) |
| ***F02M 59/46*** | (2006.01) |
| ***F02M 53/00*** | (2006.01) |
| ***F02M 69/02*** | (2006.01) |
| ***F02M 63/00*** | (2006.01) |
| ***F04B 17/03*** | (2006.01) |

(52) U.S. Cl.

CPC ..... *F02M 51/04* (2013.01); *F02M 53/00* (2013.01); *F02M 59/46* (2013.01); *F02M 63/0028* (2013.01); *F02M 69/02* (2013.01); *F04B 17/03* (2013.01)

(58) Field of Classification Search

CPC .... F02M 51/04; F02M 53/00; F02M 63/0225; F02M 63/0265; F02M 37/045; F02M 37/08; F02M 37/043; F04B 17/03; F04B 53/08

USPC ..... 123/497, 456, 514; 417/410.5, 410.1, 417/423.5, 426, 429, 415, 321, 366, 368

See application file for complete search history.

(56) References Cited

U.S. PATENT DOCUMENTS 2,460,371 A * 2/1949 Szwargulski ..... H02K 9/19 310/54
2,814,254 A * 11/1957 Litzenberg ..... F04D 13/0606 417/350
2,891,481 A * 6/1959 Franklin, Jr. ..... F04D 13/068 417/440

(Continued)

FOREIGN PATENT DOCUMENTS

DE 10 2014 215 774 B4 6/2016
EP 336060 A2 * 10/1989
EP 1574714 A2 * 9/2005 ..... F04B 23/021

*Primary Examiner* — Sizo B Vilakazi
*Assistant Examiner* — Brian R Kirby
(74) *Attorney, Agent, or Firm* — Mintz Levin Cohn Ferris Glovsky and Popeo, P.C.; Peter F. Corless

(57) ABSTRACT

A fuel pump for a liquid fuel injection system of a motor vehicle is provided. The fuel pump for a fuel injection system includes a low-pressure pump that provides liquid fuel from a fuel tank of the motor vehicle at a low pressure. A high-pressure pump in fluid communication with the low-pressure pump and compresses the liquid fuel from the low pressure to a high pressure for injecting the liquid fuel into an internal combustion engine of the motor vehicle. A pump drive drives the low-pressure pump and the high-pressure pump synchronously with a pump frequency independently from an engine speed of the internal combustion engine of the motor vehicle.

12 Claims, 3 Drawing Sheets

(56) References Cited

U.S. PATENT DOCUMENTS 3,203,352 A * 8/1965 Schafranek ..... F04D 1/06 417/350
3,507,582 A * 4/1970 Jeep, Jr. ..... F04D 9/002 417/366
3,672,793 A * 6/1972 Yowell ..... H02K 5/12 417/368
3,790,309 A * 2/1974 Volz ..... H02K 5/12 417/368
3,836,291 A * 9/1974 Bottcher ..... H02K 5/12 415/55.1
4,013,384 A * 3/1977 Oikawa ..... F04D 3/02 417/368
4,125,345 A * 11/1978 Yoshinaga ..... F04D 17/12 415/179
4,205,947 A * 6/1980 Ruhl ..... F02M 37/08 29/888.02
4,229,142 A * 10/1980 Le Dall ..... F04D 1/10 417/38
4,295,797 A * 10/1981 Ruhl ..... F02M 37/18 417/203
4,336,002 A * 6/1982 Rose ..... F04D 5/00 417/203
4,558,992 A * 12/1985 Hamano ..... F04D 27/005 417/250
4,616,980 A * 10/1986 Carpenter ..... F04D 13/0606 417/357
4,998,865 A * 3/1991 Nakanishi ..... F02M 37/08 310/51
5,088,899 A * 2/1992 Blecker ..... F04D 3/02 417/356
5,149,252 A * 9/1992 Tuckey ..... F02M 37/048 417/205
5,320,501 A * 6/1994 Langosch ..... F04B 1/20 417/203
5,336,045 A * 8/1994 Koyama ..... F04D 5/002 415/55.1
5,354,183 A * 10/1994 Eisenbacher ..... F04B 1/053 417/273
5,401,143 A * 3/1995 Yu ..... F02M 37/08 415/55.6
5,487,650 A * 1/1996 Gaston ..... F02M 37/08 415/72
5,619,971 A * 4/1997 Kubo ..... F02M 41/1405 123/41.31
5,731,643 A * 3/1998 Avakian ..... H02K 5/20 310/53
5,857,841 A * 1/1999 Kobayashi ..... F04D 13/086 417/350
5,908,020 A * 6/1999 Boutwell ..... F02M 37/10 123/541
5,971,687 A * 10/1999 Ito ..... F02M 37/08 411/238
6,068,454 A * 5/2000 Gaston ..... F04D 3/02 416/241 A
6,179,579 B1 * 1/2001 Dobler ..... F04D 13/0646 417/356
6,240,904 B1 * 6/2001 Meyer ..... F02M 37/18 123/495
6,345,609 B1 * 2/2002 Djordjevic ..... F02M 59/06 123/456
6,422,838 B1 * 7/2002 Sloteman ..... F04D 13/0666 417/423.5
6,454,543 B1 * 9/2002 Beck ..... B60T 8/4022 417/199.1
6,712,044 B1 * 3/2004 Rembold ..... F02M 37/04 123/179.17
6,729,307 B2 * 5/2004 Dong ..... F04B 11/005 123/497
6,733,249 B2 * 5/2004 Maier ..... F04C 11/001 417/310
6,758,656 B2 * 7/2004 Maier ..... F04C 11/005 417/203
7,009,317 B2 * 3/2006 Cronin ..... H02K 5/20 310/54
7,226,277 B2 * 6/2007 Dooley ..... F04D 3/02 415/72
7,231,910 B2 * 6/2007 Wagner ..... F02M 37/08 123/179.17
7,263,978 B2 * 9/2007 York ..... F04B 49/20 123/41.31
7,626,292 B2 * 12/2009 Baumann ..... H02K 5/20 165/156
7,699,592 B2 * 4/2010 Arnold ..... F04C 15/0073 418/195
7,828,530 B2 * 11/2010 Queirel ..... F04D 29/5806 417/251
8,096,782 B2 * 1/2012 McCarthy ..... F04D 1/063 417/366
8,659,190 B2 * 2/2014 Chamberlin ..... H02K 1/32 310/52
9,115,720 B2 * 8/2015 Rosinski ..... H02K 5/225
9,169,833 B2 * 10/2015 McCormick ..... H02K 5/225
9,482,175 B1 * 11/2016 Torgerud ..... F02D 41/3082
2003/0017057 A1 * 1/2003 Suzuki ..... F04B 23/026 417/206
2004/0007214 A1 * 1/2004 Schmidl ..... F04B 23/04 123/514
2005/0066649 A1 * 3/2005 Lorenz ..... F02C 9/30 60/39.281
2008/0197731 A1 * 8/2008 Kusano ..... F04B 17/03 310/86
2010/0102647 A1 * 4/2010 Savant ..... H02K 5/20 310/52
2010/0218747 A1 * 9/2010 Deichmann ..... F04D 13/0666 123/497
2011/0232270 A1 * 9/2011 Burkitt ..... F01N 9/002 60/286
2012/0080983 A1 * 4/2012 Iund ..... H02K 1/20 310/60 A
2012/0097273 A1 * 4/2012 Uryu ..... F04B 17/04 137/565.3
2015/0155766 A1 * 6/2015 Cooper ..... H02K 17/165 417/410.1
2016/0076526 A1 * 3/2016 Reukers ..... B24C 7/0007 417/415
2016/0195053 A1 * 7/2016 Shafer ..... F02M 37/18 210/806
2018/0013326 A1 * 1/2018 Mongeau ..... H02K 1/16
2018/0142642 A1 * 5/2018 Grime ..... F02D 41/3082
2019/0027987 A1 * 1/2019 Frohlich ..... H02K 1/32
2021/0180551 A1 * 6/2021 Shimoyama ..... F02M 51/0614

* cited by examiner

FUEL PUMP FOR A LIQUID FUEL INJECTION SYSTEM OF A MOTOR VEHICLE

CROSS REFERENCE TO RELATED APPLICATION(S)

The present application claims priority to German Patent Application No. 10-2020-206493.8 filed on May 25, 2020, the entire contents of which is incorporated herein for all purposes by this reference.

TECHNICAL FIELD

The present disclosure relates to a fuel pump for a liquid fuel injection system of a motor vehicle, and more particularly to a fuel pump for a gasoline direct injection system of a motor vehicle.

BACKGROUND

In order to fulfill customer demands on passenger vehicles and to meet future $CO_2$ emission as well as exhaust gas emission regulation targets, modern high efficient gasoline combustion engines often rely on gasoline direct injection (GDI). This technology enables substantial benefits especially for engines with high specific power output and compliant with the newer exhaust gas regulations. GDI generally offers the possibility to reduce the number of assembled components as well as the overall weight.

The fuel supply architecture of modern GDI engines usually delivers gasoline from a fuel tank at low pressure of around 3 to 6 bar by a continuously driven supply pump. The gasoline is then passed to a high-pressure pump configured to pressurize the gasoline to a pressure of roughly 50 to 500 bar and pump the gasoline into an injection rail and from there further to the fuel injectors. The gasoline pressure is regulated by the engine control unit (ECU) of the vehicle via the pumps.

The high-pressure pump is typically mounted and fixed onto the assembly of the respective internal combustion engine (due to the high forces of ~3500 N and higher a very rigid connection is required) and mechanically driven by a camshaft of the engine. Thus, pump frequency and/or pump rate of the high-pressure pump are coupled to the engine speed of the internal combustion engine. Furthermore, typical pump systems have a high energy demand and need to be matched to the fuel demands of the respective engine. Due to the fixed connection of the high-pressure pump, the pump's displacement needs to be matched to the highest injection quantity per stroke of the engine. As a result, typical systems may not reach the highest possible efficiencies and different types of vehicles may require different pump configurations, implying that various different pumps may be needed to fulfill consumer needs.

To stabilize pressure along an injection rail and to avoid high energy consumption, modern high pressure pumps usually employ a digital inlet valve (DIV), which regulates the amount of pressurized fuel that is transferred from low pressure to high pressure in a given time interval. DIV mostly utilize a valve that is electromagnetically actuated and emits sound at a high frequency of roughly 5 to 10 kHz.

This generates mechanic noise known as "ticking", which may be perceived as uncomfortable by end-users preferring a smooth driving experience (e.g., in particular due to the mounting position of the system on top of the engine assembly). To reduce these sound emissions, current solutions often rely on significant sound insulation around the high pressure pump potentially leading to additional costs, weight and lowered performance due to fuel heat up. In addition, since pump systems usually are matched to engine fuel demands, high variety by possible system combinations may increase costs for the manufacturer.

SUMMARY

Hence, there is a need to find pump solutions for fuel injection systems with increased efficiency and compatibility as well as reduced sound emissions. Accordingly, the present disclosure provides a fuel pump for a gasoline direct injection system of a motor vehicle.

According to one aspect of the disclosure, a fuel pump for a fuel injection system, in particular a gasoline direct injection system, of a motor vehicle may include a low-pressure pump configured to provide liquid fuel from a fuel tank of the motor vehicle at a low pressure; a high-pressure pump in fluid communication with the low-pressure pump and configured to compress the liquid fuel from the low pressure to a high pressure for injecting the liquid fuel into an internal combustion engine of the motor vehicle; and a pump drive configured to drive the low-pressure pump and the high-pressure pump synchronously with a pump frequency independently from an engine speed of the internal combustion engine of the motor vehicle.

According to another aspect of the disclosure, a motor vehicle has an internal combustion engine and a liquid fuel injection system configured to inject liquid fuel into the internal combustion engine, wherein the liquid fuel injection system has a fuel pump according to the disclosure.

According to yet another aspect of the disclosure, a method for operating a fuel pump according to the disclosure may include pumping liquid fuel with the low-pressure pump from the fuel tank of the motor vehicle at the low pressure and compressing the liquid fuel from the low pressure to the high pressure with the high-pressure pump for injecting the liquid fuel into the internal combustion engine of the motor vehicle. The low-pressure pump and the high-pressure pump may be driven synchronously by the pump drive with a pump frequency independently from an engine speed of the internal combustion engine of the motor vehicle.

The present disclosure decouples the pumps from the internal combustion engine and instead drives the low-pressure and the high-pressure pump together with a dedicated pump drive, e.g. an electric machine. Accordingly, the same pump configuration may be used for various different engines and vehicle types, resulting in a reduction of total costs and a simplification of the vehicle supply infrastructure. In addition, the pump system no longer needs to be mounted on top of the internal combustion engine and hence sound emissions, in particular those of the DIV, may be reduced or completely avoided. In fact, the pump system may be installed anywhere in the vehicle, e.g. in an underfloor or in an isolated box within the engine cabinet spaced apart from the actual engine. Moreover, the DIV of the pump system may be eliminated entirely. By utilizing one common drive for both pump systems, power consumption may be reduced significantly by optimized state of operation.

According to the disclosure, the pump drive may be configured to drive the pumps with a pump frequency independently from an engine speed of the internal combustion engine of the motor vehicle. Due to the presence of a dedicated pump drive, the pumps no longer need to be mechanically driven by a camshaft of the engine. Hence, the pump frequency does not need to be coupled to the engine speed anymore. Accordingly, the pump configuration and behavior may be tuned in an optimized way for each type of vehicle, type of engine and driving situation with one single type of pump. The resulting system may thus be optimized to provide the highest possible efficiency or other features such as start ability and independent rail pressure for each case without having to compromise due to an interconnection with the engine.

Additionally, the present disclosure may be particularly employed for GDI systems. However, the disclosure is also applicable to other fuel injection systems based on liquid and/or liquefied fuels comprising but not limited to liquefied natural gas (LNG), compressed natural gas (CNG), liquefied petroleum gas (LPG), hydrogen and so on.

According to an exemplary embodiment of the disclosure, the pump drive may be an electric motor. It is to be understood however that the pump drive may be another power source driven independently of the engine speed of the internal combustion engine. For example, the pump drive may be a pneumatic motor, a hydraulic motor and so on.

According to an exemplary embodiment of the disclosure, the pump drive may include at least two electric submachines axially coupled to each other between the low-pressure pump and the high-pressure pump. For example, two brushless direct current (DC) motors may be used to generate a sufficient power output, e.g. 500 W or more, and an additional boost functionality to manage high engine gradients, e.g. to boost the power output from 500 W up to 1000 W on very short time scales. As a result, flexibility for high pressure and/or flow gradients may be realized. Moreover, a stable injection rail pressure may be secured over the full dynamic range of the engine/vehicle. In other exemplary embodiments, even three, four or more electric submachines may be coupled to each other to further increase flexibility of the system.

According to an exemplary embodiment of the disclosure, each electric submachine may include a helical cooling channel configured to flush the liquid fuel from a low-pressure side to a high-pressure side along a helical path around an axial direction of the respective electric submachine. Accordingly, the liquid fuel itself may be used to cool down the pump drive, which inevitably generates a certain amount of heat. As the electric submachines are mounted between the low-pressure pump and the high-pressure pump, the fuel may be used for this purpose travelling between the low-pressure side and the high-pressure side. For example, the fuel may be guided through an outer hull of the electric submachines.

It will be clear to the person of skill that a similar cooling mechanism may also be employed when the pump drive is not split up into two or more submachines. In that case, the pump drive may still be mounted between the low-pressure pump and the high-pressure pump and may carry one or several helical cooling channels, e.g. along an outer side or hull, from the low-pressure side to the high-pressure side.

According to an exemplary embodiment of the disclosure, each helical cooling channel may be integrated into an outer hull of the respective electric submachine. Accordingly, a cooling flow along the complete outer side or surface of the electric submachines may be accomplished for optimized cooling of the pump drive. The fuel pump may further include a hydraulic regulator configured to provide a pressure regulated connection between the electric submachines for conducting the liquid fuel between the electric submachines. The hydraulic regulator may be configured to adjust the internal flow of the fuel and maintain internal pressure of the fuel flow. The internal pressure regulation system may help to properly fill the fuel pump with fuel and to cool the pump drive.

The hydraulic regulator may include an overflow return valve for pressure regulating a backflow of liquid fuel from the high-pressure side to the low-pressure side. Since the low-pressure pump typically requires a higher displacement of ~10-20% than the high-pressure pump, any surplus fuel may be flushed back to the low-pressure side. The hydraulic regulator thus may provide a regulation line besides a main supply line. This may become necessary in certain applications for three reasons. First, the fuel pump may need to uphold a certain relative pressure. Second, first soaking may require recirculation=to evacuate the system. Third, any fuel remaining after the engine is shut off may heat up, which could increase an internal pressure as well as a vapor content. An increasing pressure could be released through this valve.

The regulation may provide additional advantages over conventional systems. The usually utilized pressure membranes are not required anymore. And furthermore, such a pressure stabilization may allow to use various liquefied fuels like LNG, LPG, CNG etc. Besides an overflow, the hydraulic regulator may also include a secondary relief outlet for filling of an additional intake manifold injection system. According to an exemplary embodiment of the disclosure, the high-pressure pump may include a suction piston for compressing the liquid fuel being conducted from the low-pressure pump to the high-pressure pump and a crank drive driven by the pump drive and configured to drive the suction piston.

Hence, in the present disclosure, a crank drive actuated by the pump drive may replace the typically employed camshaft driven by the internal combustion engine. The suction piston (or plunger) may be configured in an optimized way to provide a convenient lift range (e.g., lift range for low mass per lift, however high enough to compress and deliver enough fuel). The solution may employ one common shaft for synchronous fuel flow from a fuel tank via the low-pressure pump to the high-pressure pump. According to an exemplary embodiment of the disclosure, the fuel pump may be configured to operate in a pump frequency range between 0 rpm and about 16.000 rpm with a fuel flow rate between 0 kg/h and about 100 kg/h.

The pressure at the injection rail may be stabilized and adjusted precisely in case the fuel is delivered in such small hubs over such a large frequency range. The low pressure may be in a range between 1 bar and about 10 bar and/or the high pressure may be in a range between about 50 bar and 500 bar. For example, the low pressure may be between roughly about 3 bar and 6 bar. The high pressure on the other hand may be between about 250 bar and 350 bar, for example.

According to an exemplary embodiment of the disclosure, the pump drive may be a brushless DC motor. The electric motor may provide enough power and torque required by the present solution. The electric motor may have a maximum power output of at least 500 W at an operating voltage of 48 V. The fuel pump may further include a pump control unit configured to operate the fuel pump based on pressure control commands based on on-board diagnostics controller area network (CAN) signals.

The pump controller may include rail pressure control logic, e.g. based on an actual rail pressure and a rail pressure set point. By using on-board diagnostics CAN signals (OBD-CAN) the system may be further simplified as OBD messages may be used for simple control features, e.g. rail pressure control. Since these types of messages follow international standards, it may be possible to provide the fuel pump in any vehicle independently from the manufacturer.

According to an exemplary embodiment of the disclosure, the fuel pump may be mechanically detached from the internal combustion engine of the motor vehicle. However, the fuel pump may be in fluid communication with the internal combustion engine via a fuel line. For example, the fuel pump may be mounted within an underfloor of a vehicle and thus be spaced apart from the internal combustion engine. A fuel hose, tube or pipe may provide the necessary fluid connection to an injection rail of the engine.

According to an exemplary embodiment of the disclosure, the fuel pump may be powered by a vehicle battery of the motor vehicle. For example, a standard 12 V battery may be employed. When a 48 V electric motor is used, a DC/DC converter may be coupled between the battery and the electric motor. According to an exemplary embodiment of the disclosure, the pump controller of the fuel pump may be communicatively coupled to an engine controller of the motor vehicle. Thus, a dedicated pump controller may be provided, which may, for example, receive power from a battery of the vehicle and may power the pump drive of the fuel pump. However, in other exemplary embodiments, the pump controller be integrated into the engine controller.

The disclosure will be explained in greater detail with reference to exemplary embodiments depicted in the drawings as appended.

BRIEF DESCRIPTION OF THE DRAWINGS

The accompanying drawings are included to provide a further understanding of the present disclosure and are incorporated in and constitute a part of this specification. The drawings illustrate the embodiments of the present disclosure and together with the description serve to explain the principles of the disclosure. Other embodiments of the present disclosure and many of the intended advantages of the present disclosure will be readily appreciated as they become better understood by reference to the following detailed description. The elements of the drawings are not necessarily to scale relative to each other. In the figures, like reference numerals denote like or functionally like components, unless indicated otherwise.

Figure 1:
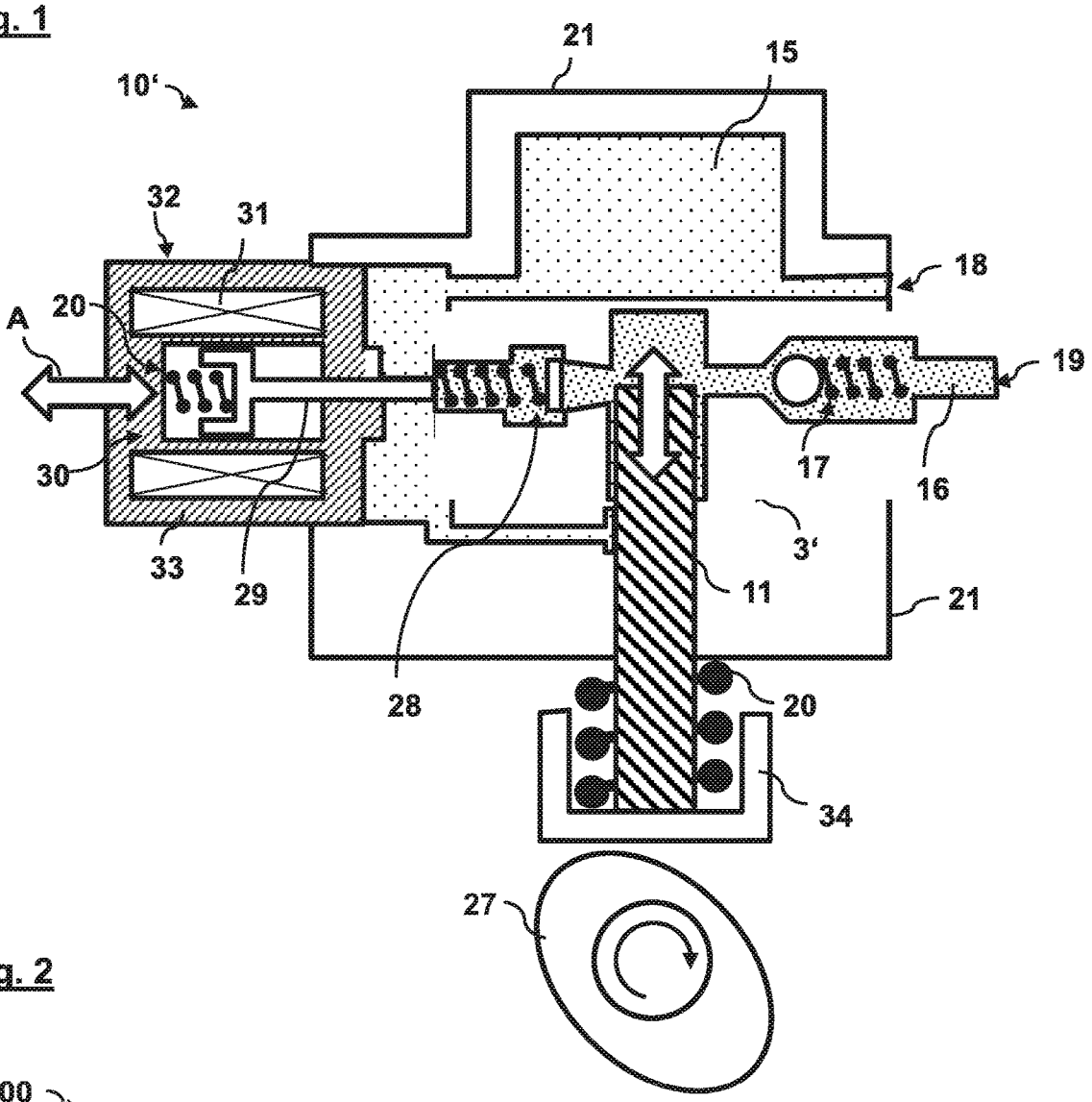
FIG. 1 schematically depicts an example of aspects of a fuel injection system comprising a high pressure pump.

Although exemplary embodiments are illustrated and described herein, it will be appreciated by those of ordinary skill in the art that a variety of alternate and/or equivalent implementations may be substituted for the specific embodiments shown and described without departing from the scope of the present disclosure. Generally, this application is intended to cover any adaptations or variations of the exemplary embodiments discussed herein.

DETAILED DESCRIPTION OF THE EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

Furthermore, control logic of the present disclosure may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 2:
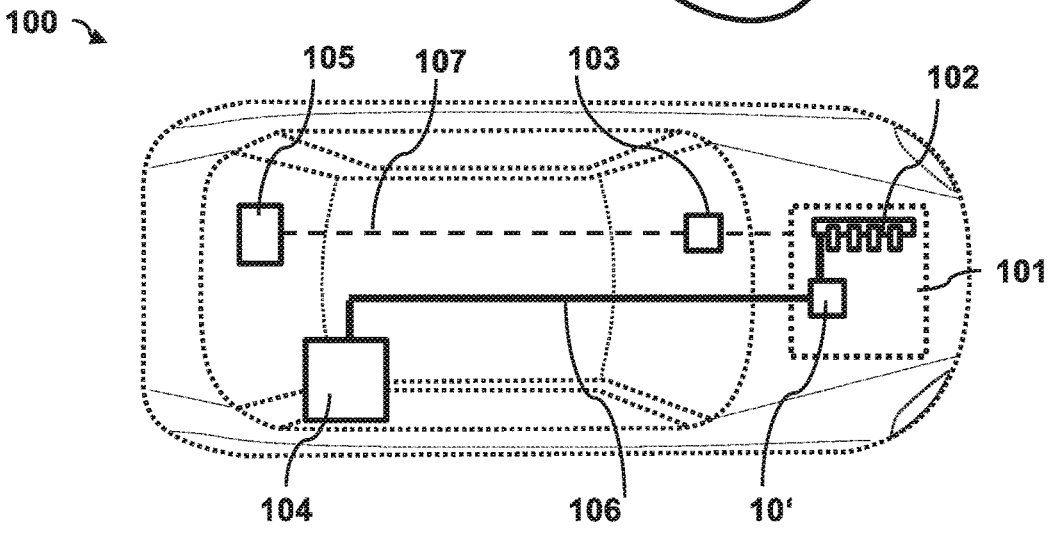
FIG. 2 schematically shows a motor vehicle comprising the fuel injection system of FIG. 1.

FIG. 1 schematically depicts an example of aspects of a fuel injection system 10', which may particularly be a gasoline direct injection (GDI) system 10' including a digital inlet valve (DIV) 32. FIG. 2 schematically shows a motor vehicle 100 comprising the fuel injection system 10' of FIG. 1.

Since modern vehicles are required to meet highest demands concerning consumption, emission and performance standards, gasoline vehicles are mostly equipped with direct fuel injecting systems. Gasoline direct injection indicates that the fuel is injected by an injector directly into a combustion chamber (not depicted) of the engine 101, which then realizes an internal gas mixture. The system 10' includes a low pressure (supply) fuel pump (also not depicted here), which pumps the gasoline at low pressures (e.g. ~3 bar) from a fuel tank 104 of the vehicle 100 through a fuel line 106 and via a low pressure fuel inlet 18 into a low pressure fuel chamber 15 of the GDI system 10'. The digital inlet valve 32 shown in FIG. 1 now regulates transfer of the gasoline from the low-pressure fuel chamber 15 to a high pressure fuel chamber 16 of a high pressure fuel pump 3', from where it is ejected via a high pressure fuel outlet 19 into an injection rail 102 and injected into the combustion chamber of the engine 101.

The high pressure pump 3' is configured to compress the demanded fuel quantity for the injection to a required pressure level, e.g. 50 bar up to roughly 500 bar. Accordingly, the high pressure pump 3' is driven with a plunger and/or suction piston 11 resiliently connected to a tappet 34 via a return spring 20, the tappet 34 in turn being connected to a camshaft 27 of the engine 101. Thus, a pump frequency of the high pressure pump 3' is driven by the speed of the internal combustion engine 101 (cf. arrow at the suction piston 11 in FIG. 1 indicating an oscillating movement of the suction piston 11). The DIV 32 thus has to be actuated at a specific time to deliver an adequate amount of fuel within a given time window. The DIV 32 is operated by an engine control unit (ECU) 103 of the engine 101 based on various sensor data. The ECU 103 in turn is driven by a vehicle battery 105 of the vehicle 100.

The DIV 32 is accommodated inside a DIV housing 33 and includes three separate functional components: a valve seat 28, a valve piston 29 and a valve actuator 30 (cf. left side in FIG. 1). The valve seat 28 is configured to seal the high pressure fuel chamber 16 of the GDI system 10' against the low-pressure fuel chamber 15 of the GDI system 10' in a closed configuration of the DIV 32. The valve piston 29 is configured to move the valve seat 28 between the closed configuration and an open configuration of the DIV 32, in which the high pressure fuel chamber 16 is in fluid connection with the low-pressure fuel chamber 15. The valve actuator 30 is configured as an electromagnetic linear actuator to actuate movement of the valve piston 29 along an actuation direction A.

The three functional components, namely the valve seat 28, the valve piston 29 and the valve actuator 30 are joined together in one single integrated component, e.g. made from steel or the like. For example, the functional components may be welded together. The DIV 32 is provided as one fully integrated single structural element to reduce manufacturing costs and simplify the supply chain. The GDI system 10', that is, in particular the DIV 32 and the high-pressure pump 3', is mounted to the engine 101 in a rigid connection, e.g. via a bracket or similar component. This rigid connection is required due to the high forces of several thousand Newton, which are acting on the components during operation.

In general, all vibrating surfaces transfer their movement into the air, which in turn generates spherical outspreading waves. These waves have nearly the same frequency as the vibrating body. The resulting sound or acoustic noise is also called solid-borne sound. In simplified conditions, solid-borne sound corresponds to the resonance frequency of the whole body, including its physical boundaries of mass, stiffness and damping.

Vehicle's noise emission remains one of the key challenges to meet end-user satisfaction. Powertrain acoustics influences, by positive association, in case of "sportive" sound and negative perception in case for harsh sounds. Studies show that common GDI systems are one major source for mechanic noise emission. Particularly in idle condition, this circumstance may be annoying to both driver and pedestrians. The high pressure pump in modern gasoline direct injection engines may be perceived as acoustically annoying due to a "ticking" noise, which is emitted over the otherwise very smooth operation of these engines. This ticking sound mainly stems from the fast closing and opening movement of the digital inlet valve 32 regulating fuel inlet into the high pressure pump 3'. This noise is enhanced due to the fact that the GDI system 10' is mounted on top of the engine 101. Thus, solid borne sound is transmitted via the engine 101 through the entire vehicle 100.

Studies reveal that GDI system noise covers a range between 1.6 kHz up 16 kHz. In simplified terms, this range may be split in two major areas for pump function. Pressure generation impacts the area from roughly 1.6 to 5 kHz, while the digital inlet valve impacts the area from 5 to 10 kHz. The last mentioned range represents the above-mentioned "ticking" noise.

Moreover, the high-pressure pump 3' is driven by the camshaft 27 of the engine 101 and thus a pump frequency (e.g., pump speed) follows the engine speed of the engine 101. This arrangement may not be optimal in terms of pump and injection efficiency as the pump 3' displacement has to be matched to the engine's 101 highest injection quantity per stroke. Since the layout of the high-pressure pump 3' has to tackle maximum fuel delivery rate over the whole engine duty regime, the pump 3' will usually be run in a part load area. However, as a person of ordinary skill would be aware, parts which are running or operating in part load operation do not meet maximum capable efficiency levels. In addition, since every part has a specific efficiency mapping, a fixed operation condition does not result in highest operation efficiency. Thus, power consumption of the part is increased.

Figure 3:
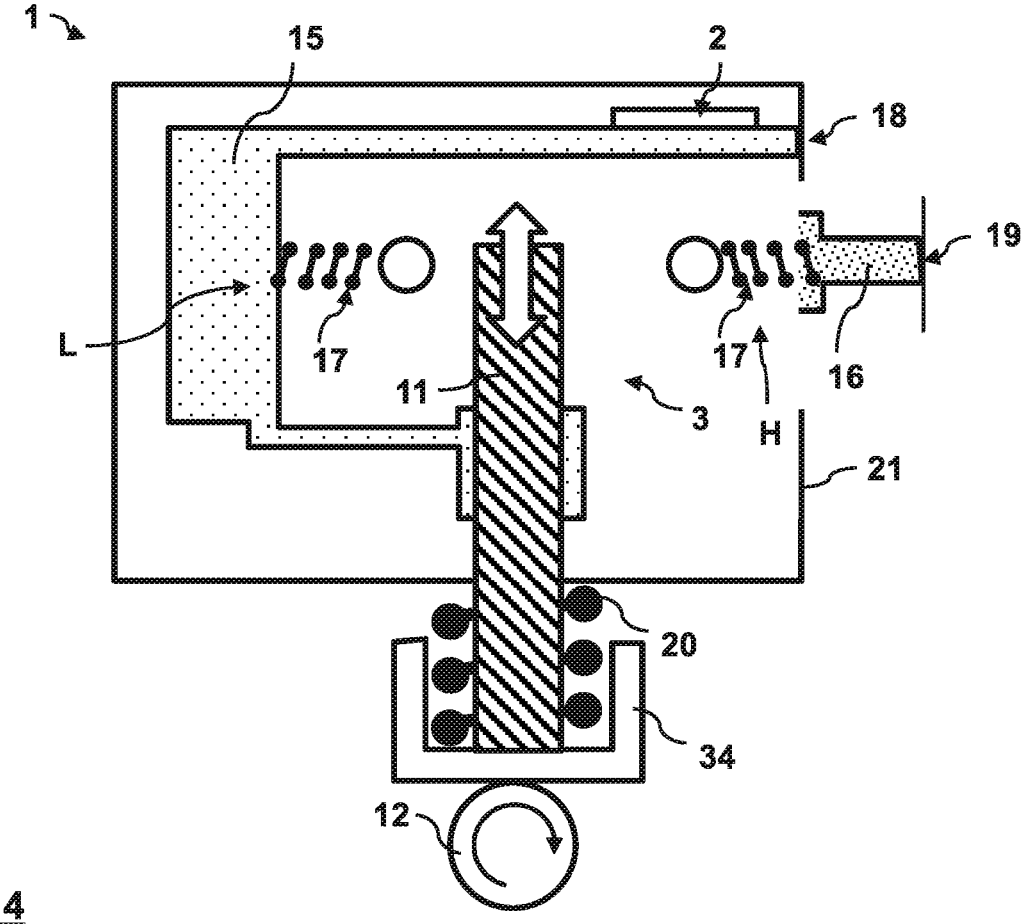
FIG. 3 schematically depicts a fuel pump for a high pressure range of a liquid fuel injection system according to an exemplary embodiment of the disclosure.
Figure 4:
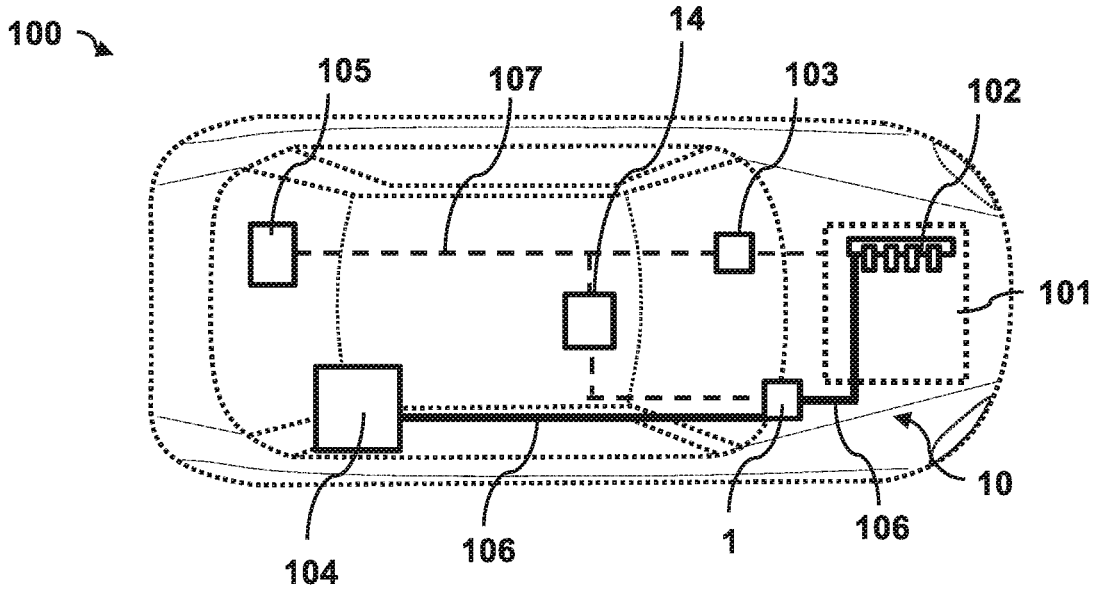
FIG. 4 schematically shows a motor vehicle comprising a liquid fuel injection system with the fuel pump of FIG. 3 according to an exemplary embodiment of the disclosure.
Figure 5:
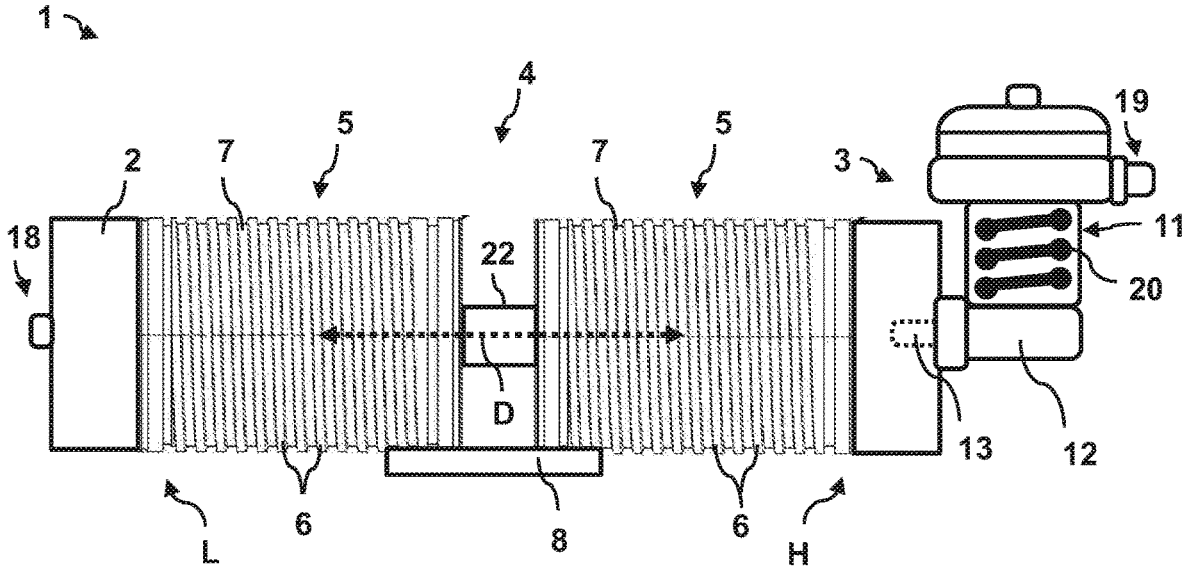
FIG. 5 shows a side view of a fuel pump assembly of the fuel pump from FIG. 3 according to an exemplary embodiment of the disclosure.

The above drawbacks are overcome by the liquid fuel injection system 10 discussed with reference to FIGS. 3 to 7. FIGS. 3 and 5 schematically depict a fuel pump 1 of a fuel injection system 10 according to an exemplary embodiment of the disclosure. FIG. 5 particularly shows a side view of an assembly of the fuel pump 1, wherein the fuel pump 1 is shown without an outer hull or housing. FIG. 4 shows a motor vehicle 100 including a fuel injection system 10 with the fuel pump 1 of FIGS. 3 and 5. FIG. 7 shows a flow diagram of a method M for operating the fuel pump 1 of FIGS. 3 and 5.

The system 10 may be configured as a GDI system for pumping gasoline from a fuel tank 104 of the vehicle 100 and injecting the gasoline into the engine 101 via an injection rail 102. In other exemplary embodiments, however, the system 10 may inject other forms of liquid fuels, e.g. liquefied fuels like LNG, LPG, CNG and so on. Accordingly, the system 10 may include a low-pressure pump 2 configured to provide liquid fuel from the fuel tank 105 at a low pressure, e.g. at about 3 bar to 6 bar. The system 10 may further include a high-pressure pump 3 in fluid communication with the low-pressure pump 2 and configured to compress the liquid fuel from the low pressure to a high pressure, e.g. of about 250 bar to 350 bar, for injecting the liquid fuel into the internal combustion engine 101 of the motor vehicle 100.

Accordingly, the low-pressure pump 2 may be realized in various forms, e.g. as a gear pump (for low fuel quality), a vane or geroter pump (e.g. in racing applications), a side channel pump (to soak liquid fuel and partly liquid fuel) and so on. However other applicable pump and operation methods are feasible. The high-pressure pump 3 on the other hand may be provided as a simple 2-poppet valve solution including a poppet valve 17 on a low-pressure side L and a poppet valve 17 on a high-pressure side H.

In contrast to the system 10' of FIGS. 1 and 2, the system 10 of FIGS. 3 to 7 may further include a pump drive 4 configured to drive the low-pressure pump 2 and the high-pressure pump 3 synchronously. The pump drive 4 may be configured to drive a crank drive 12 of the high-pressure pump 3, which is connected to a tappet 34, which in turn drives a suction piston 11 of the high-pressure pump 3 being configured to compress the liquid fuel. The crank drive 12 is shown with a return spring 20 in FIG. 5. It is to be understood however that the crank drive may be configured without such a spring 20 in a rigid assembly between the piston 11 and the tappet 34. A spring may help in some applications to stabilize the system. Depending on the specific use, the suction piston 11 may be configured with a suitable lift range, e.g. of about 2 mm to 5 mm. The lift range should be adapted for low mass per lift but high enough to compress and deliver sufficient fuel.

Hence, in the exemplary embodiment of FIGS. 3 to 7, the high-pressure pump 3 is not coupled to a camshaft of the engine 101. Instead the high-pressure pump 3 is completely decoupled from the engine 101 and solely driven by the pump drive 4 provided for this particular purpose. In fact, the entire fuel pump 1 may be mechanically detached and spaced apart from the internal combustion engine 101 (cf. FIG. 4). For example, the pump 1 may be mounted within an underfloor of the vehicle 100 or within a separate compartment in the engine cabinet.

Consequently, the pump drive 4 may be configured to drive the pumps 2, 3 with a pump frequency independently from an engine speed of the internal combustion engine 101 of the motor vehicle 100. Thus, the solution of this exemplary embodiment turns away from the commonly followed approach of fixedly connecting the GDI system to the engine mechanics. This overcomes the drawbacks of the system 10' of FIGS. 1 and 2, as will be explained further below.

The method M for operating the fuel pump 1 may include accordingly under M1 pumping liquid fuel with the low-pressure pump 2 from the fuel tank 105 of the motor vehicle 100 at the low pressure and under M2 compressing the liquid fuel from the low pressure to the high pressure with the high-pressure pump 3 for injecting the liquid fuel into the internal combustion engine 101 of the motor vehicle 100 (cf. FIG. 7). In particular, the low-pressure pump 2 and the high-pressure pump 3 may be driven synchronously by the pump drive 4 with a pump frequency independently from an engine speed of the internal combustion engine 101 of the motor vehicle 100.

Figure 6:
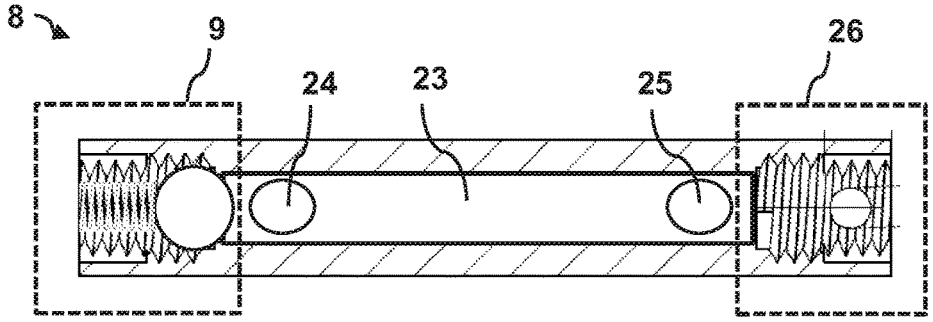
FIG. 6 shows a cross-sectional view of a hydraulic regulator of the fuel pump in FIG. 5 according to an exemplary embodiment of the disclosure.
Figure 7:
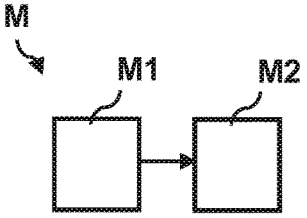
FIG. 7 shows a flow diagram of a method for operating the fuel pump of FIG. 3 according to an exemplary embodiment of the disclosure.

Referring now to FIGS. 5 and 6, the pump drive 4 is configured as an electric motor and may include two electric submachines 5 axially coupled to each other via an electric and mechanical connection 22 between the low-pressure pump 2 and the high-pressure pump 3. Each electric submachine 5 may include a helical cooling channel 6 integrated into its respective outer hull 7, which is configured to flush the liquid fuel from the low-pressure side L (that is, from the low-pressure pump 2) to the high-pressure side H (i.e. to the high-pressure pump 3) along a helical path around an axial direction D of the respective electric submachine 5.

Both electric submachines 5 may be fluidly connected to each other via a hydraulic regulator 8 providing a pressure regulated connection between the electric submachines 5 for conducting the liquid fuel between the electric submachines 5, that is, between the helical cooling channels 6 of both submachines 5.

The hydraulic regulator 8 is shown in more detail in FIG. 6. As shown, the hydraulic regulator 8 may include a main regulator supply line 23 for transporting the liquid fuel from the helical cooling channel 6 of the electric submachine 5 on the low-pressure side L to the electric submachine 5 on the high-pressure side H, that is, from left to right in FIG. 5. Accordingly, the hydraulic regulator 8 may include a regulator inlet 24 and a regulator outlet 25 in fluid connection with the main regulator supply line 23 on the one side and the respective cooling channel 6 on the other. The regulator inlet 24 and the regulator outlet 25 may, for example, be configured as simple ball valves or the like.

Furthermore, the hydraulic regulator 8 may include an overflow return valve 9 for pressure regulating a backflow of liquid fuel from the high-pressure side H to the low-pressure side L (left in FIG. 6) as well as a relief outlet 26 (right in FIG. 6) for filling a parallel intake manifold injection system of the vehicle 100 (not depicted). The latter offers the possibility to combine manifold and direct injection with one pump system. The fuel pump 1 may be configured to operate in a pump frequency range between 0 rpm and about 16.000 rpm with a fuel flow rate between 0 kg/h and about 100 kg/h to be able to deliver the liquid fuel in small quantities but with high pump speed to the injection rail 102. This offers the possibility to control the injection process more accurately. Rapid transitions between different driving situations may be handled due to this in a highly effective way.

The pump drive 4 may be configured as a brushless DC motor or similar, e.g. with each electric submachine 5 being able to deliver up to about 500 W at an operating voltage of 48 V (48 V may be more suitable than 12 V as the latter may encounter high currents). A vehicle battery 105 may deliver the necessary electric energy to the pump drive 4 via a dedicated electric line 107. A DC-DC converter (not depicted) may be configured to convert the 12 V of the vehicle battery 105 to the 48 V required by the pump drive 4.

The fuel pump 1 may include a pump control unit 14 or pump controller, which is shown in FIG. 4 spaced apart from the fuel pump 1 for the sake of clarity. It is to be understood however, that the pump controller it 14 may be integrated into the fuel pump 1. In this particular exemplary embodiment, the pump controller 14 is provided in addition to an ECU 103. However, in other exemplary embodiments, the control functions of the pump controller 14 may be fulfilled by the ECU 103. A separate pump controller 14 may enable to retrofit the present system 10 in vehicles equipped with conventional systems.

The fuel pump 1 may be configured to receive power from the pump controller 14, which in turn is powered by the vehicle battery 105. The pump controller 14 may include rail pressure control logic, e.g. based on actual values and predefined set points. The pump controller 14 may particularly be configured to operate the fuel pump 1 based on pressure control commands based on on-board diagnostics CAN signals for further simplification. These signals follow international standards and thus the system 10 may be used across different manufacturers without modification.

The present disclosure thus is able to significantly reduce the ticking noise of common digital inlet valves by decoupling the fuel injection system 10 and in particular the fuel pump 1 from the engine 100. The digital inlet valve may be omitted entirely. Since the fuel pump 1 may be driven by a dedicated pump drive 4, the pump 1 may be configured relatively freely (compared to the conventional systems) and thus one single pump type may fulfill the requirements of various different types of vehicles for diverse driving situations and engine conditions. This also means that the power consumption of the fuel system may be lowered.

As a result, the number of parts and the total costs may be reduced and the whole supply infrastructure may be simplified. To achieve this, the present disclosure follows a completely new pump approach based on synchronously driven low- and high-pressure pumps and a "one-shaft" arrangement of pumps 2, 3 and electric machines 5 (cf. FIG. 5, which shows the arrangement of these components along one shared axis). The present system may be provided as a retrofit and back-up solution without having to access the ECU on a developer level.

In the foregoing detailed description, various features are grouped together in one or more examples or examples with the purpose of streamlining the disclosure. It is to be understood that the above description is intended to be illustrative, and not restrictive. It is intended to cover all alternatives, modifications and equivalents of the different features and exemplary embodiments. Many other examples will be apparent to one skilled in the art upon reviewing the above specification. The exemplary embodiments were chosen and described in order to explain the principles of the disclosure and its practical applications, to thereby enable others skilled in the art to utilize the disclosure and various exemplary embodiments with various modifications as are suited to the particular use contemplated.

REFERENCE LIST

1 fuel pump
2 low-pressure pump
3, 3' high-pressure pump
4 pump drive
5 electric submachine
6 helical cooling channel
7 outer hull
8 hydraulic regulator
9 overflow return valve
10, 10' liquid fuel injection system
11 suction piston
12 crank drive
13 crank shaft
14 pump control unit
15 low-pressure fuel chamber
16 high-pressure fuel chamber
17 poppet valve
18 low-pressure fuel inlet
19 high-pressure fuel outlet
20 return spring
21 pump housing
22 electromechanical connector
23 main regulator supply line
24 regulator inlet
25 regulator outlet
26 relief outlet
27 engine camshaft
28 valve seat
29 valve piston
30 valve actuator
31 magnetic coil
32 digital inlet valve (DIV)
33 DIV housing
34 tappet
100 motor vehicle
101 internal combustion engine
102 injection rail
103 engine control unit (ECU)
104 fuel tank
105 vehicle battery
106 fuel line
107 electric line
L low-pressure side
H high-pressure side
D axial direction
A actuation direction
M method
M1, M2 method steps

What is claimed is:

1. A pump for a liquid fuel injection system of a motor vehicle, comprising:

a low-pressure pump configured to provide liquid fuel from a fuel tank of the motor vehicle at a low pressure;

a high-pressure pump in fluid communication with the low-pressure pump and configured to compress the liquid fuel from the low pressure to a high pressure for injecting the liquid fuel into an internal combustion engine of the motor vehicle; and a pump drive configured to drive the low-pressure pump and the high-pressure pump synchronously with a pump frequency independently from an engine speed of the internal combustion engine of the motor vehicle, wherein the pump drive is configured as an electric motor, wherein the pump drive includes at least two electric submachines axially coupled to each other between the low-pressure pump and the high-pressure pump, and wherein each electric submachine includes a helical cooling channel configured to flush the liquid fuel from a low-pressure side to a high-pressure side along a helical path around an axial direction of the respective electric submachine.

2. The fuel pump according claim 1, wherein each helical cooling channel is integrated into an outer hull of the respective electric submachine.

3. The fuel pump according to claim 2, further comprising a hydraulic regulator configured to provide a pressure regulated connection between the electric submachines for conducting the liquid fuel between the electric submachines.

4. The fuel pump according to claim 3, wherein the hydraulic regulator includes an overflow return valve for pressure regulating a backflow of liquid fuel from the high-pressure side to the low-pressure side.

5. The fuel pump according to claim 4, wherein the high-pressure pump includes a suction piston configured to compress the liquid fuel being conducted from the low-pressure pump to the high-pressure pump and a crank drive driven by the pump drive and configured to drive the suction piston.

6. The fuel pump according to claim 5, wherein the pump drive is a brushless direct current (DC) motor.

7. The fuel pump according to claim 6, further comprising a pump controller configured to operate the fuel pump based on basis of pressure control commands based on on-board diagnostics controller area network (CAN) signals.

8. A motor vehicle comprising an internal combustion engine and a liquid fuel injection system configured to inject liquid fuel into the internal combustion engine), the liquid fuel injection system having a fuel pump according to claim 1.

9. The motor vehicle according to claim 8, wherein the fuel pump is mechanically detached from the internal combustion engine of the motor vehicle, and wherein the fuel pump is in fluid communication with the internal combustion engine via a fuel line.

10. The motor vehicle according to claim 9, wherein the fuel pump is powered by a vehicle battery of the motor vehicle.

11. The motor vehicle according to claim 10, wherein the pump controller of the fuel pump is communicatively coupled to an engine controller of the motor vehicle.

12. A method for operating a fuel pump according to claim 1, comprising:

pumping liquid fuel with the low-pressure pump from the fuel tank of the motor vehicle at the low pressure; and compressing the liquid fuel from the low pressure to the high pressure with the high-pressure pump for injecting the liquid fuel into the internal combustion engine of the motor vehicle;

wherein the low-pressure pump and the high-pressure pump are driven synchronously by the pump drive with the pump frequency independently from the engine speed of the internal combustion engine of the motor vehicle.

* * * * *